United States Patent [19]

Cohen

[11] 3,940,135

[45] Feb. 24, 1976

[54] HOCKEY GAME

[76] Inventor: Samuel W. Cohen, c/o George Spector, 3615 Woolworth Bldg., 233 Broadway, New York, N.Y. 10007

[22] Filed: Mar. 25, 1974

[21] Appl. No.: 454,618

Related U.S. Application Data

[63] Continuation of Ser. No. 289,609, Sept. 18, 1972, abandoned, which is a continuation-in-part of Ser. No. 95,814, Dec. 7, 1970, abandoned.

[52] U.S. Cl. ..... 273/85 F; 46/240; 273/1 M; 273/128 R

[51] Int. Cl.[2] ..... A63F 7/06; A63F 9/14

[58] Field of Search ..... 273/1 M, 85, 86 B, 94, 273/128 R; 46/239, 240

[56] References Cited

UNITED STATES PATENTS

| | | | |
|---|---|---|---|
| 1,656,936 | 1/1928 | Beal | 273/128 R |
| 2,964,320 | 12/1960 | Lebrun | 273/85 A |
| 3,036,388 | 5/1962 | Tate | 46/239 X |
| 3,214,171 | 10/1965 | Luchsinger | 273/1 M X |
| 3,827,692 | 8/1974 | Morrison et al. | 273/85 F |

FOREIGN PATENTS OR APPLICATIONS

| | | | |
|---|---|---|---|
| 392,351 | 5/1965 | Switzerland | 273/85 F |
| 277,470 | 9/1927 | United Kingdom | 273/94 R |
| 495,427 | 11/1938 | United Kingdom | 273/94 R |
| 311,256 | 11/1955 | Switzerland | 273/85 R |

*Primary Examiner*—Anton O. Oechsle
*Assistant Examiner*—Harry G. Strappello
*Attorney, Agent, or Firm*—Darby & Darby

[57] ABSTRACT

A hockey game having a game board with a pair of spaced apart transparent plates and at least one magnetic actuator moving on the outer surface of a plate. Team members which can be attracted by the magnetic actuator are disposed in the space between the plates to slide on the upper surface of the bottom plate as an actuator is moved to hit and propel a puck. The team members are of three-dimensional construction to have an impact surface to the puck at any orientation. In the preferred embodiment, an area of the top plate is recessed and certain of the team members are of increased height confining their movement by an actuator in the area of the board which is not recessed.

14 Claims, 5 Drawing Figures

HOCKEY GAME

This application is a continuation of my prior copending application Ser. No. 289,609 filed Sept. 18, 1972, now abandoned, which application was a continuation-in-part of the then copending application Ser. No. 95,814, filed Dec. 7, 1970, which latter application is also now abandoned.

This invention relates to game devices of the type generally termed as indoor or table top games. More specifically, the present invention is a continuation in part of applicant's patent Application on HOCKEY GAME, Ser. No. 95,814, filed Dec. 7, 1970, now abandoned.

A principle object of the present invention is to provide a hockey game of the type described in Applicant's previous Application, and wherein the game is further improved by allowing only the puck to enter the goal, and preventing the playing pieces from entering it, thus giving more realism to the game.

Another object is to provide an improved hockey game in which the goalie playing piece is confined to move only in the goal vicinity so to also add realism to the game.

Yet other objects are to provide an improved hockey game device in which the puck includes resilient means around its periphery so that it rebounds when striking any object; wherein the hockey stick may be selectively lengthened or shortened; and wherein the game device may be selectively raised or lowered to suit the opposing players.

Figure 1:
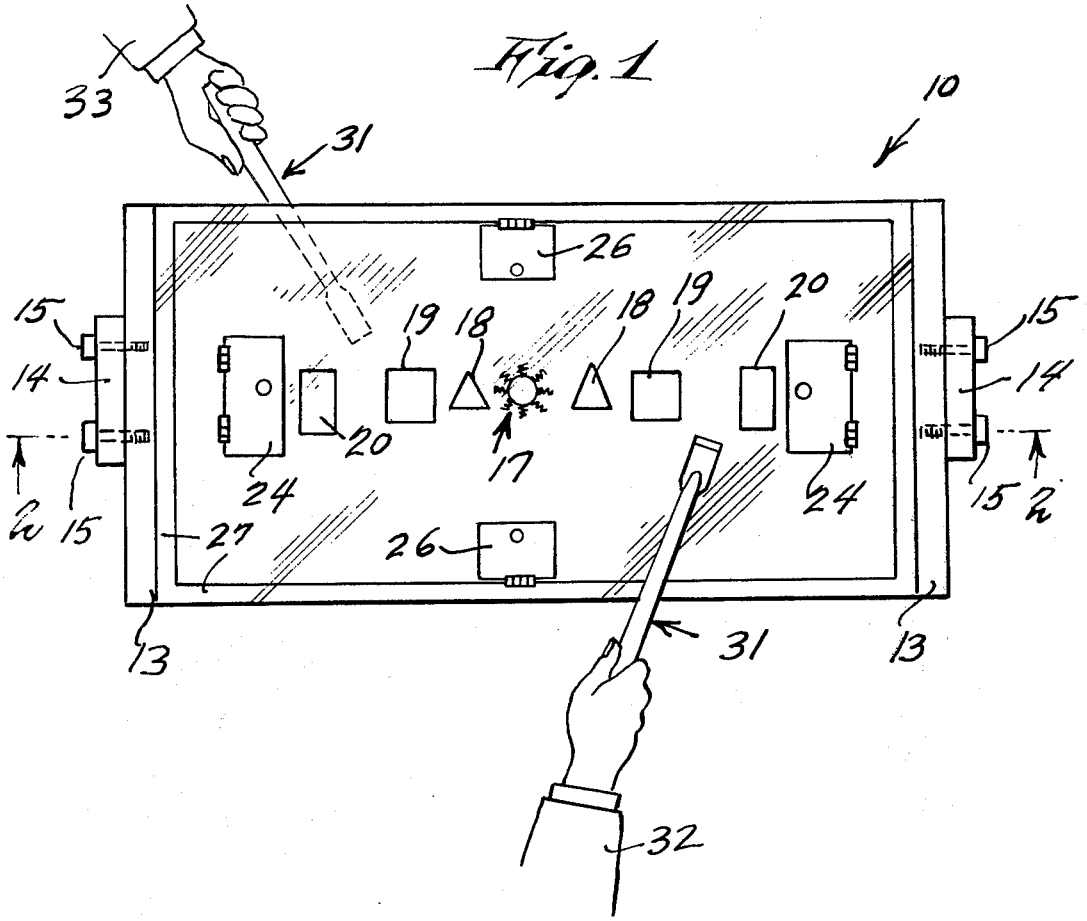
FIG. 1 is a top plan view of the improved hockey game device.

Referring now to the drawings in detail, the reference numeral 10 represents an improved hockey game according to the present invention wherein there are a pair of horizontal spaced apart, upper and lower, glass or plastic transparent plates 11 and 12 supported at opposite ends in blocks 13. The block 13 is positioned on posts 14 by means of knurl headed screws 15, so that the game board elevation can be adjusted for the players.

Figure 2:
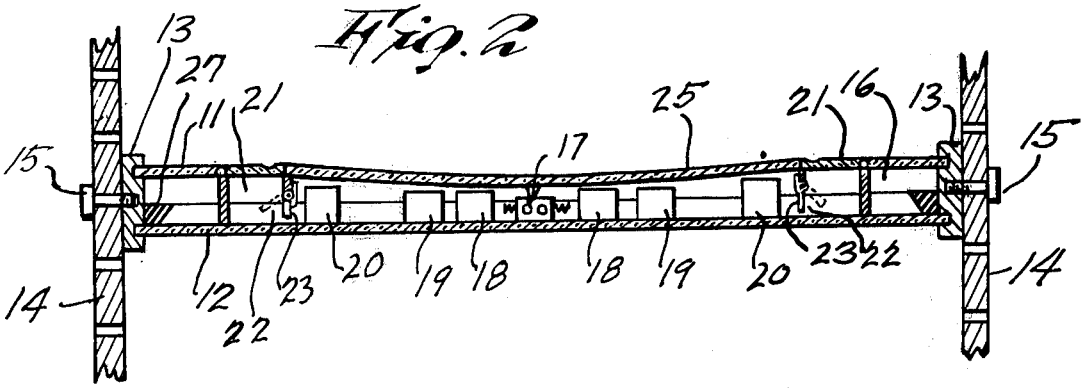
FIG. 2 is a cross section on line 2—2 of FIG. 1.
Figure 3:
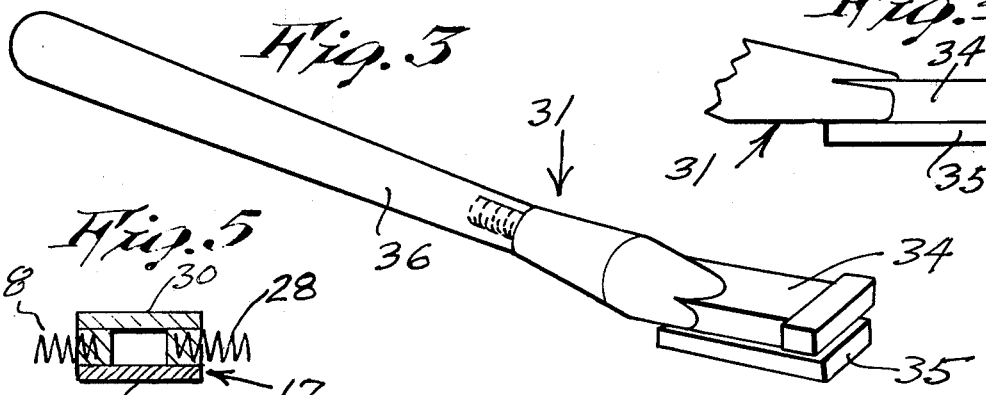
FIG. 3 is a perspective view of the hockey stick used in the improved game.
Figure 4:
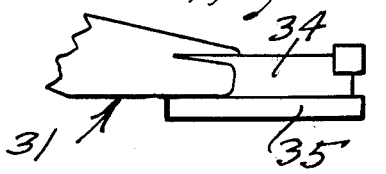
FIG. 4 is a fragmentary side view of the hockey stick.
Figure 5:
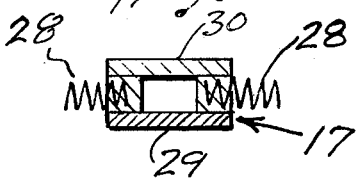
FIG. 5 is a side cross sectional view of the puck.

In the space 16 between the plates 11 and 12 various playing pieces are movable and which include a puck 17, forward players 18, guards 19 and goalies 20. Each of the playing pieces 18, 19 and 20 includes a magnetic attractive steel material while the puck 17 is of a non-magnetic material. As shown in FIG. 2, the puck 17 is of least height of the playing pieces, while the goalies 20 are tallest. The other playing pieces 18 and 19 are of a height that is in between these.

A goal 21 is provided near each opposite end of the game board and into which only the puck 17 can enter due to a low doorway 22 in which a door 23 is pivotable inwardly only as shown by dotted lines in FIG. 2. By this arrangement the puck can enter the doorway but cannot exit therefrom. An upwardly pivotable door 24 on top of each goal in the upper plate 11 of the board allows a person to reach in and remove the puck from the goal. The low doorway 22 prevents the playing pieces other than the puck from entering the goal. The doors 24 are flush with the upper surface.

The top plate 11 is downwardly dished toward its center, as shown at 25, so that the tall goalie playing pieces 20 cannot get under the center area of the dish section of the plate 11. Thus confines each goalie to move only in the area around his own goal. The forward 18 and guard 19 playing piece are of a height that allows them to move anywhere between the plates 11 and 12, except into the goals.

A pair of upwardly pivotable trap doors 26 provide access for a player to place the puck between the plates for play after removing it form a goal. Doors 26 are flush with upper surface so as not to hinder the stick as it moves across the plate 11.

A rubber cushion 27 frames the playing area between the plates and the playing pieces after hitting it will rebound therefrom.

The puck 17 additionally has a plurality of coil springs 28 extending in all directions around its periphery for rebounding purpose. The puck 17 includes a lead plate 29 on its bottom, and a cover 30 on its top.

To play the game, each player holds a hockey stick 31. One player 32 holds his hockey stick on the top surface of upper plate 11 while the other player 33 holds his hockey stick on the bottom surface of the bottom plate 12. Each hockey stick has a permanent mangnet 34 so to magnetically attract the playing pieces and thus move them during the game. Each hockey stick has a shoe 35 on the bottom of its magnet which is of a low friction coefficient material, such as Teflon, so not to scratch the transparent plates 11 and 12 each hockey stick also has a threaded, removable handle 36 that is interchangable with other longer or shorter handles.

In an alternate construction design, instead of gradually sloping or dishing the top plate 11, it may be stepped by a shoulder, thus preventing the goalie from becoming jammed or wedged.

Also in an alternate design the puck 17 forwards 18 and guards 19 may be of the same height, but the puck may be of narrower diameter or width. Thus, if doorway 22 is made likewise narrow, only the puck can enter it, thereby keeping the pieces 18 and 19 from the goal.

Trap door hinges and knobs are preferably made flush with the top surface of plate 11 so to not interfer with the hockey stick movement on top.

Preferably, the guards 19 are preferably square, the forwards 18 are triangular and lighter in weight than the guards, the end goalies 20 are rectangular and the heaviest of the players. The triangular lighter construction of the forwards 18 permit a more rapid penetration movement. Also, the narrower pointed corners of the triangular forwards can be offensively displayed to wedge between the puck and opponents players to pry the puck away.

The lead weight 29 in the puck keeps the puck flat and prevents it from turning over.

In playing the game each player manipulates his stick 31 across the surface of a plate to carry a player 18, 19 or 20 with the stick due to the magnetic attraction between the magnet 34 on the stick and each player. When the player being propelled by the stick hits the non-magnetic puck, the puck is propelled.

While various changes may be made in the detail construction, it is understood that such changes will be within the spirit and scope of the present invention, as is defined by the appended claims.

I claim as follows:

1. A hockey game comprising upper and lower plates, means for mounting said plates on peripheral sides thereof with the inner face of one plate in an opposing relationship to the inner face of the other plate to define a hollow board forming an arena simulating a hockey court, at least the upper plate being transparent, a goal in the space between said plates toward each end position of the arena, said opposing inner faces of said plates having a maximum uniform spacing in the arena area surrounding the goals and a smaller spacing inwardly toward the center of the board, a plurality of team members disposed slidably within the arena, said team members including a goalie of a height greater than said smaller spacing towards the center of the arena so that the movement of the goalie is confined to movement within the larger area surrounding the goals and prevented in the area of smaller spacing by contact of the goalie with the portion of a plate defining the area of smaller spacing, the heights of all of said team members other than said goalie being less than the space between the opposing inner faces of the plates over the entire area of said arena, each said team member including magnetically attractable material, magnetic actuator means having a planar surface adapted to glide on the outer surface of one of said plates for attracting a team member when it is aligned with the magnetically attractable material of a said team member, movement of the actuator means on the outer surface of a plate causing the magnetically attracted team member to move across the corresponding inner face of the plate with the actuator means as it is moved, and a non-magnetic puck for gliding on the inner surface of the lower plate adapted to be struck by a said team member as it is moved by a said actuator means.

2. A hockey game as in claim 1 wherein the puck is of lesser height than any of said team members and further comprising barrier means adjacent each goal for permitting entry only by the puck into the goal area, and means associated with said barrier means for preventing exit of said puck.

3. A hockey game as in claim 2 wherein the barrier means includes a fixed upper portion preventing entry into the goals of the team members and a lower movable portion which moves only one way to permit entry of the puck into the goal area and prevents the puck from leaving the goal area.

4. A hockey game as in claim 1 wherein an actuator means includess a shoe of a low coefficient friction material integrally mounted thereon to provide the planar gliding surface thereby preventing scratching of the surface on which it glides.

5. A hockey game as in claim 1 wherein said team members are three dimensional objects having a generally closed peripheral face therearound to provide impact faces for the puck irrespective of the orientation of each team member with respect to the puck.

6. A hockey game as in claim 5 further comprising doors at various locations in at least one of said plates permitting access to the arena and goal areas, said doors being movable to an open position and being continuously flush with the outer surface of the plate on which it is located when in the closed position.

7. A hockey game as in claim 5 wherein the team members include goalies in the shape of an elongated rectangle, guards in the shape of a square of smaller height and of lighter weight than the goalie and forwards in the shape of a triangle which is of smaller size and lighter in weight than the guards.

8. A hockey game to accommodate two players comprising a hollow board having opposing spaced upper and lower plates mounted on peripheral sides enclosing an arena simulating the playing area of a hockey court, at least the upper one of said plates being transparent, said game including a respective actuator means for each of the players having a planar gliding surface for movement in sliding relationship exteriorly on the outer surface of each of said plates, means for mounting the board to leave the outer surface of the lower plate accessible for unobstructed movement thereover by a said actuator means by a player beneath the playing area of the hockey court, a hockey puck of non-magnetic material disposed in sliding relationship on the inner surface of said lower plate, a plurality of team members disposed slidably within the hollow area defined by the plates, each of said team members being a three dimensional object having a vertically extending surface forming a vertical impact face for the puck therearound at all angular orientations of a said member with respect to the puck, the overall vertical height of each of said team members being slightly less than the space between the opposing inner surfaces of the plates in the area in which it is to move, each of said team members each having a gliding face adapted to glide on the inner surface of a respective plate on which it is to slide, each of said actuator means and each of said team members having means thereon which are mutually magnetically attractive at all angular orientations of a said actuator means with respect to a said team member when a said actuator means is placed opposite the gliding face of a said team member with a respective one of said upper or lower plates therebetween so that a team member will be attracted by an actuator means and the team member will be moved on its gliding face across the inner surface of the respective plate along with the movement of the actuator means on the outer surface of said plate with the vertical face of a team member impacting the puck to move it as a team member is moved by the actuator means into engagement with the puck.

9. A hockey game as in claim 8 wherein the puck includes a plurality of springs extending externally from said puck in a generally horizontal direction whereby the puck will spring away from the members and all surrounding sides of the arena to keep the puck in active play at all locations.

10. A hockey game as in claim 9 wherein the puck is hollow and includes a heavy weight at its lower portion to maintain gliding stability.

11. A hockey game as in claim 8 further comprising a goal means disposed within the hollow space between the opposing surfaces of said plates.

12. A hockey game as in claim 8 further comprising a rigid stick extending diagonally outwardly from a said actuator means to simulate a hockey stick.

13. A hockey game as in claim 8 wherein each of said upper and lower plates is transparent.

14. A hockey game as in claim 8 wherein said puck is at least half as high as each of said team members to present a relatively large impact area between the puck and a said team member.

* * * * *